US008858271B2

(12) United States Patent
Yeung et al.

(10) Patent No.: US 8,858,271 B2
(45) Date of Patent: Oct. 14, 2014

(54) SPEAKER INTERCONNECT

(71) Applicant: Apple Inc., Cupertino, CA (US)

(72) Inventors: Alex Yeung, San Francisco, CA (US); Carl Peterson, Santa Clara, CA (US); Julio Quintero, Los Gatos, CA (US); Kevin Gibbs, San Carlos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/654,943

(22) Filed: Oct. 18, 2012

(65) Prior Publication Data

US 2014/0113478 A1 Apr. 24, 2014

(51) Int. Cl.
*H01R 4/36* (2006.01)

(52) U.S. Cl.
USPC ..... 439/792

(58) Field of Classification Search
USPC ..... 439/801, 810, 796, 797, 910, 271, 507, 439/359; 174/541, 521
See application file for complete search history.

(56) References Cited

U.S. PATENT DOCUMENTS

| | | | | |
|---|---|---|---|---|
| 1,893,291 | A | 1/1933 | Kwartin | |
| 4,068,103 | A * | 1/1978 | King et al. | 381/409 |
| 4,081,631 | A | 3/1978 | Feder | |
| 4,089,576 | A * | 5/1978 | Barchet | 439/507 |
| 4,245,642 | A * | 1/1981 | Skubitz et al. | 607/37 |
| 4,466,441 | A * | 8/1984 | Skubitz et al. | 607/115 |
| 4,658,425 | A | 4/1987 | Julstrom | |
| 5,106,318 | A * | 4/1992 | Endo et al. | 439/189 |
| 5,293,002 | A * | 3/1994 | Grenet et al. | 174/541 |
| 5,335,011 | A | 8/1994 | Addeo et al. | |
| 5,406,038 | A | 4/1995 | Reiff et al. | |
| 5,570,324 | A | 10/1996 | Geil | |
| 5,604,329 | A * | 2/1997 | Kressner et al. | 174/528 |
| 5,619,583 | A | 4/1997 | Page et al. | |
| 5,733,153 | A * | 3/1998 | Takahashi et al. | 439/801 |
| 5,879,598 | A | 3/1999 | McGrane | |
| 6,036,554 | A * | 3/2000 | Koeda et al. | 439/797 |
| 6,073,033 | A | 6/2000 | Campo | |
| 6,129,582 | A | 10/2000 | Wilhite et al. | |

(Continued)

FOREIGN PATENT DOCUMENTS

| | | |
|---|---|---|
| EP | 2094032 | 8/2009 |
| GB | 2310559 | 8/1997 |

(Continued)

OTHER PUBLICATIONS

Baechtle et al., "Adjustable Audio Indicator," IBM, 2 pages, Jul. 1, 1984.

(Continued)

*Primary Examiner* — Alexander Gilman
(74) *Attorney, Agent, or Firm* — Brownstein Hyatt Farber Schreck, LLP

(57) ABSTRACT

An interconnect for an internal device, such as a speaker, coupling power from a flexible connector to the speaker at two or more terminals. The interconnect includes a flexible element, such as a "minus" terminal, and a second element, such as a "plus" terminal, which are coupled to corresponding terminals on the flexible connector. A screw can be threaded through a hole in the flexible element, the corresponding terminals, and can be terminated at the second element. The screw presses the "minus" terminal and the "plus" terminal into their corresponding terminals, making an electrical connection and a physical connection.

20 Claims, 3 Drawing Sheets

(56) References Cited

U.S. PATENT DOCUMENTS

| | | | | |
|---|---|---|---|---|
| 6,151,401 | A | 11/2000 | Annaratone | |
| 6,154,551 | A | 11/2000 | Frenkel | |
| 6,192,253 | B1 | 2/2001 | Charlier et al. | |
| 6,317,237 | B1 | 11/2001 | Nakao et al. | |
| 6,400,825 | B1 | 6/2002 | Miyamoto et al. | |
| 6,813,218 | B1 | 11/2004 | Antonelli et al. | |
| 6,829,018 | B2 | 12/2004 | Lin et al. | |
| 6,882,335 | B2 | 4/2005 | Saarinen | |
| 6,934,394 | B1 | 8/2005 | Anderson | |
| 7,003,099 | B1 | 2/2006 | Zhang et al. | |
| 7,082,322 | B2 | 7/2006 | Harano | |
| 7,154,526 | B2 | 12/2006 | Foote et al. | |
| 7,158,647 | B2 | 1/2007 | Azima et al. | |
| 7,263,373 | B2 | 8/2007 | Mattisson | |
| 7,266,189 | B1 | 9/2007 | Day | |
| 7,362,877 | B2 | 4/2008 | Honda et al. | |
| 7,378,963 | B1 | 5/2008 | Begault et al. | |
| 7,527,523 | B2 * | 5/2009 | Yohn et al. | 439/564 |
| 7,536,029 | B2 | 5/2009 | Choi et al. | |
| 7,570,772 | B2 | 8/2009 | Sorensen et al. | |
| 7,679,923 | B2 * | 3/2010 | Inagaki et al. | 361/752 |
| 7,867,001 | B2 * | 1/2011 | Ambo et al. | 439/271 |
| 7,878,869 | B2 * | 2/2011 | Murano et al. | 439/792 |
| 7,903,061 | B2 | 3/2011 | Zhang et al. | |
| 7,912,242 | B2 * | 3/2011 | Hikichi | 381/433 |
| 7,966,785 | B2 | 6/2011 | Zadesky et al. | |
| 8,031,853 | B2 * | 10/2011 | Bathurst et al. | 379/202.01 |
| 8,055,003 | B2 | 11/2011 | Mittleman et al. | |
| 8,116,505 | B2 | 2/2012 | Kawasaki-Hedges et al. | |
| 8,116,506 | B2 | 2/2012 | Kuroda et al. | |
| 8,204,266 | B2 | 6/2012 | Frigola Munoz et al. | |
| 8,218,397 | B2 | 7/2012 | Chan | |
| 8,226,446 | B2 * | 7/2012 | Kondo et al. | 439/719 |
| 8,264,777 | B2 | 9/2012 | Skipor et al. | |
| 8,340,312 | B2 | 12/2012 | Johnson et al. | |
| 8,409,417 | B2 | 4/2013 | Wu | |
| 8,417,298 | B2 | 4/2013 | Mittleman et al. | |
| 8,447,054 | B2 | 5/2013 | Bharatan et al. | |
| 8,452,037 | B2 | 5/2013 | Filson et al. | |
| 8,488,817 | B2 | 7/2013 | Mittleman et al. | |
| 8,560,309 | B2 | 10/2013 | Pance et al. | |
| 8,574,004 | B1 * | 11/2013 | Tarchinski et al. | 439/507 |
| 8,620,162 | B2 | 12/2013 | Mittleman | |
| 8,632,670 | B2 | 1/2014 | Garimella et al. | |
| 2004/0203520 | A1 | 10/2004 | Schirtzinger et al. | |
| 2005/0271216 | A1 | 12/2005 | Lashkari | |
| 2006/0072248 | A1 | 4/2006 | Watanabe et al. | |
| 2008/0204379 | A1 | 8/2008 | Perez-Noguera | |
| 2008/0292112 | A1 | 11/2008 | Valenzuela et al. | |
| 2008/0310663 | A1 | 12/2008 | Shirasaka et al. | |
| 2009/0274315 | A1 | 11/2009 | Carnes et al. | |
| 2010/0062627 | A1 * | 3/2010 | Ambo et al. | 439/189 |
| 2011/0002487 | A1 | 1/2011 | Panther et al. | |
| 2012/0082317 | A1 | 4/2012 | Pance et al. | |
| 2012/0177237 | A1 | 7/2012 | Shukla et al. | |
| 2012/0250928 | A1 | 10/2012 | Pance et al. | |
| 2012/0263019 | A1 | 10/2012 | Armstong-Muntner | |
| 2013/0017738 | A1 * | 1/2013 | Asakuma et al. | 439/810 |
| 2013/0051601 | A1 | 2/2013 | Hill et al. | |
| 2013/0129122 | A1 | 5/2013 | Johnson et al. | |
| 2013/0164999 | A1 * | 6/2013 | Ge et al. | 439/801 |
| 2013/0259281 | A1 | 10/2013 | Filson et al. | |
| 2013/0280965 | A1 * | 10/2013 | Kojyo | 439/722 |
| 2014/0140558 | A1 | 5/2014 | Kwong | |

FOREIGN PATENT DOCUMENTS

| | | |
|---|---|---|
| GB | 2342802 | 4/2000 |
| JP | 2102905 | 4/1990 |
| JP | 2004153018 | 5/2004 |
| JP | 2006297828 | 11/2006 |
| WO | WO03/049494 | 6/2003 |
| WO | WO2004/025938 | 3/2004 |
| WO | WO2007/083894 | 7/2007 |
| WO | WO2008/153639 | 12/2008 |
| WO | WO2009/017280 | 2/2009 |
| WO | WO2011/057346 | 5/2011 |
| WO | WO2011/061483 | 5/2011 |

OTHER PUBLICATIONS

Pingali et al., "Audio-Visual Tracking for Natural Interactivity," Bell Laboratories, Lucent Technologies, pp. 373-382, Oct. 1999.

Blankenbach et al., "Bistable Electrowetting Displays," https://spie.org/x43687.xml, 3 pages, Jan. 3, 2011.

* cited by examiner

SPEAKER INTERCONNECT

TECHNICAL FIELD

This application generally relates to an internal device interconnect, such as might be used for a speaker or another device, and related matters.

BACKGROUND

When electronic devices are relatively small, there can sometimes be difficulty in allowing space for internal connectors. For example, in mobile devices or other portable or hand-held electronic devices, electrical connections to a speaker can occupy more space than desired. This might have the effect of making the device larger than desired, or requiring a smaller speaker than desired.

It sometimes occurs that multiple electrical connections are desired at or near one device within such electronic devices. For example, for a speaker assembly in a relatively smaller device, at least some electrical connections are desired to be able to provide substantial electrical power. In such examples, a powered electrical connection is desired, but which might occupy substantial space within the structure of the device, and thus might provide less room for routing electronic signals.

It sometimes occurs that assembly (or re-assembly) of relatively smaller devices can be made complex or difficult by routing requirements for electrical power or electronic signals. For example, in mobile devices or other portable or hand-held electronic devices, it might occur that relatively smaller parts are used, both for electrical connections and for electronic signal connections. One such example might be a speaker element, which might itself be incorporated into a device as a package, but which might involve multiple connections to other parts of the device.

Each of these examples, as well as other possible considerations, can cause one or more difficulties for designers and builders of relatively smaller devices, particularly mobile devices or other portable or hand-held electronic devices.

BRIEF SUMMARY OF THE DISCLOSURE

This application provides techniques, including assemblies, circuits and designs, which can make multiple electrical connections at or near a device or subassembly. In one embodiment, the device interconnect can include an assembly having connectors coupled to the device, contact pads on a flex element, an aligned hole defined by those elements, and a screw or similar element disposed therein. For example, the assembly can couple the device and the flex element electrically or electronically.

In one embodiment, the assembly can include a first and a second connector to a device or subassembly. For a first example, the device can include a speaker, and the first and second connector can include electrical power connectors. For a second example, the device can include another device having power inputs, such as a haptic feedback element (e.g., a vibrating element or a buzzer).

In one embodiment, the assembly can include a first and a second contact pad on a flex element. For example, the flex element can include a flexible member including internal electrical or electronic connectors. In such cases, the internal electrical or electronic connectors can couple the contact pads to one or more locations relatively remote from the device or subassembly.

In one embodiment, the assembly can include a screw or similar element positioned in an aligned hole defined by the connectors and contact pads. For example, the screw can terminate at a stop element coupled to the second connector. In such cases, contact between the connectors and contact pads provides an electrical connection between the device and the flex element, while contact between the screw and the stop element can provide a physical connection between the device and the flex element.

In one embodiment, the assembly can include an electrical isolator disposed between the screw and the first contact pad. For a first example, the electrical isolator can include an insulating object positioned between a screw head and the first connector. For a second example, the screw can itself comprise, or be coated with, an electrically nonconductive material, such as ceramic or plastic.

In one embodiment, the device interconnect can include more than one assembly as described herein. For a first example, the flex element can include more than one set of contact pads, and can be coupled to more than one device. For a second example, the device can include more than one set of connectors, and can be coupled to more than one flex element.

While multiple embodiments are disclosed, including variations thereof, still other embodiments of the present disclosure will become apparent to those skilled in the art from the following detailed description, which shows and describes illustrative embodiments of the disclosure. As will be realized, the disclosure is capable of modifications in various obvious aspects, all without departing from the spirit and scope of the present disclosure. Accordingly, the drawings and detailed description are to be regarded as illustrative in nature and not restrictive.

DETAILED DESCRIPTION

Terminology

The following terminology is exemplary, and not intended to be limiting in any way.

The text "in one embodiment", and variants thereof, generally refers to one or more possible ways in which a device can be constructed or a method can be performed. While the phrase "in one embodiment" is used more once in this application, in the context of the invention, there is no particular requirement that more than one reference to "one embodiment" refers to the same possible device or method. Instead, the invention has sufficient scope and power that each reference to "in one embodiment" stands on its own.

After reading this application, those skilled in the art would recognize that these terms and phrases would be applicable to techniques, methods, physical elements, and systems (whether currently known or otherwise), including extensions thereof inferred or inferable by those skilled in the art after reading this application.

Interconnect Assembly

Figure 1:
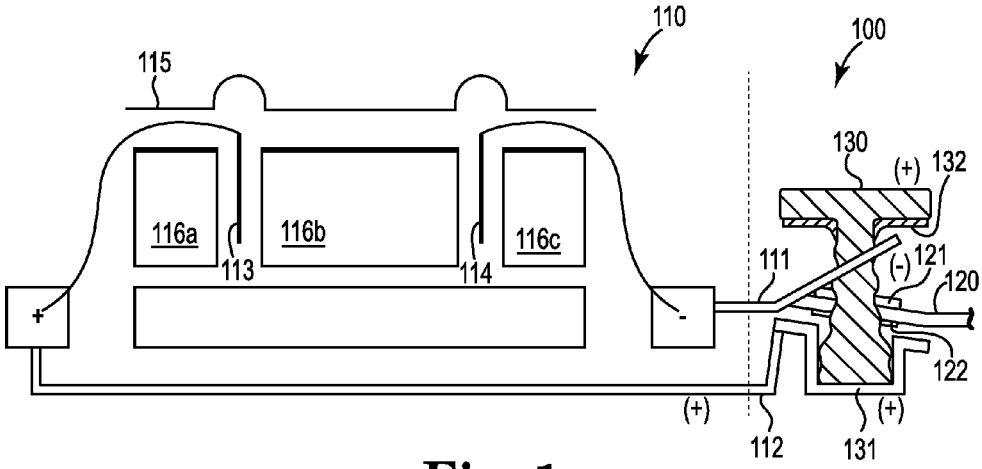
FIG. 1 shows a conceptual drawing of a first view of a device interconnect.
Figure 2:
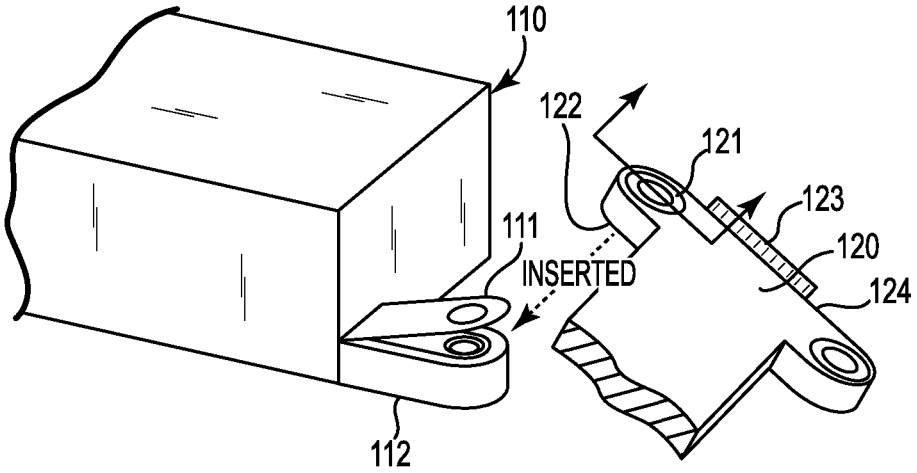
FIG. 2 shows a conceptual drawing of a second view of a device interconnect.
Figure 3:
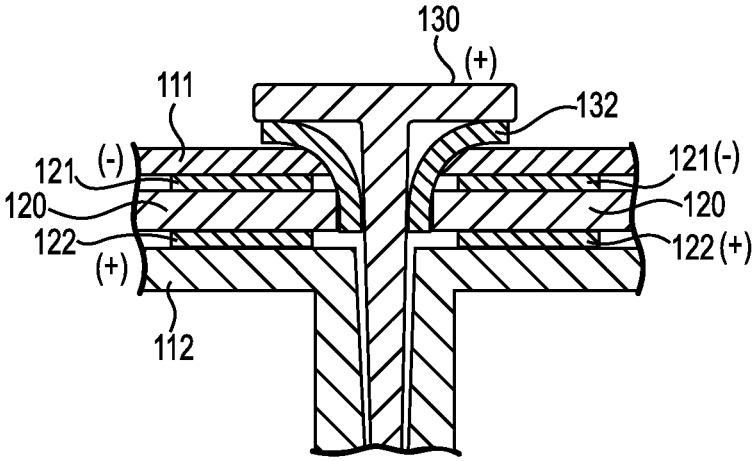
FIG. 3 shows a conceptual drawing of a third view of a device interconnect.

FIG. 1 shows a first conceptual drawing of a first view of a device interconnect. FIG. 2 shows a second conceptual drawing of a second view of a device interconnect. FIG. 3 shows a third conceptual drawing of a third view of a device interconnect.

In one embodiment, an assembly 100 can be coupled to a device 110, such as a speaker or other subassembly disposed in a mobile device or other portable or hand-held electronic device, and to another element, such as described herein. The assembly 100 can couple the device 110 to the other element physically, at least in that the device 110 and the other element are stabilized with respect to their relative positions. The assembly 100 can also couple the device 110 to the other element electrically or electronically, at least in that the device 110 and the other element are operatively coupled.

In one embodiment, the assembly 100 can include, coupled to the device 110, a first connector 111 and a second connector 112, such as coupled to an anode and cathode for the device 110, sometimes referred to herein as "minus" and "plus" connectors. For example, the first connector 111 and the second connector 112 can be coupled to power inputs for a speaker.

In alternative embodiments, the first connector 111 and the second connector 112 can be coupled to power inputs for another device or another type of device, such as a haptic feedback element, such as a vibrating element or buzzer, or one or more other devices coupleable to power inputs.

In one embodiment, the first connector 111 is disposed at a relatively bent angle with respect to the second connector 112, with the effect that a substantial space can be made available between the first connector 111 and the second connector 112. For example, a substantial space can include a sufficient space that a flex element 120, as described herein, can be relatively easily placed between the first connector 111 and the second connector 112.

In one embodiment, the assembly 100 can include the flex element 120, which can include a relatively flexible element capable of conveying electrical power or electronic signals, such as to a relatively remote location. The flex element 120 can include a first coupling pad 121 and a second coupling pad 122, and can be disposed so that the flex element 120, including the first coupling pad 121 and the second coupling pad 122, can be relatively easily placed between the between the first connector 111 and the second connector 112.

For example, the first connector 111 can be disposed relatively near the first coupling pad 121 and the second connector 112 can be disposed relatively near the second coupling pad 122. This can have the effect that if the first connector 111 is bent to close the relatively bent angle between the first connector 111 and the second connector 112, the first connector 111 will be electrically coupled to the first coupling pad 121 and the second connector 112 will be electrically coupled to the second coupling pad 122.

In one embodiment, the first connector 111, the first coupling pad 121, the flex element 120, the second coupling pad 122, and the second connector 112, can each define its own hole or other relatively empty space. This can have the effect that when the first connector 111, the first coupling pad 121, the flex element 120, the second coupling pad 122, and the second connector 112, are aligned, an aligned and unified hole or other relatively aligned empty space can be defined. This allows a screw 130 or other element to be disposed in the aligned hole.

In alternative embodiments, the hole defined by the second connector 112 can be coupled to a stop element 131 disposed to admit the screw 130. This can have the effect that the screw 130 can be screwed into the stop element 131. For a first example, the stop element 131 can form a U-shape at which the screw 130 stops when screwed into the stop element 131. For a second example, the stop element 131 can define a hole through which the screw 130 is positioned when screwed into the stop element 131.

While the stop element 131 is primarily described as disposed to admit the screw 130, in the context of the invention, there is no particular requirement for any such limitation. For example, the stop element 131 can include a relatively soft material, such as a relatively soft plastic, into which the screw 130 can be driven when the screw 130 is driven into the aligned hole.

In one embodiment, the assembly 100 includes an isolator 132 disposed to electrically separate the screw 130 from the first connector 111, and from the first contact pad 121. For example, the isolator 132 can include an insulating material disposed in a collar shape about the screw 130 and below the head of the screw 130.

As shown in FIG. 3, the isolator 132 can allow the screw 130 to contact the second connector 112, thus being a "plus" electrical terminal, without contacting the first connector 111 or the first contact pad 121. This can have the effect of preventing the screw 130 from creating an electrical short between the first connector 111 and the second connector 112, or preventing the screw 130 from creating an electrical short between the first contact pad 121 and the second connector 112.

In alternative embodiments, the isolator 132 is disposed to instead electrically separate the screw 130 from the second connector 112, and from the second contact pad 122. For example, the screw 130 may be allowed to instead contact the first connector 111, thus being a "minus" electrical terminal, without contacting the second connector 112 or the second contact pad 122.

In alternative embodiments, the isolator 132 is disposed to electrically separate the screw 130 both from the first connector 111 and from the second connector 112, and both from the second connector 112 and from the second contact pad 122. For example, the screw 130 may be prevented from being either a "plus" electrical terminal or a "minus" electrical terminal, and may be prevented from contacting any of the electrically active elements of the assembly 100.

While the assembly 100 is primarily described as including the screw 130, in the context of the invention, there is no particular requirement for any such limitation. For example, the aligned hole of the assembly 100 can be disposed to admit a pin, rivet, spring, or other element. Any such element would have the effect of stabilizing the aligned hole, so that the assembly 100 would not be relatively easily subject to physical disassembly. This would have the effect that the first connector 111 would not be relatively easily subject to physical disconnection from the first coupling pad 121, and the second connector 112 would not be relatively easily subject to physical disconnection from the second coupling pad 122.

In one embodiment, more than one such assembly 100 can be coupled to the device 110. For example, the device 110 can be coupled to more than one set of first and second connectors. This can have the effect that the device 110 can be coupled to more than one flex element 120. In such cases, the coupling between the device 110 and the more than one flex element 120 can be physical, at least in that the device 110 and each of the more than one flex element 120 can have their positions stabilized with respect to each other. In such case, the coupling between the device 110 and the more than one flex element 120 can be electrical or electronic, at least in that the device 110 and each of the more than one flex element 120 can be so coupled.

Flex Element

In one embodiment, the flex element 120 can include a first electrical element (not shown), coupled to the first coupling pad 121, and disposed to couple the first coupling pad 121 to a first relatively remote electrical or electronic node (not shown). In such cases, the first electrical element is substantially internal to the flex element 120, and is capable of maintaining an electrical or electronic connection when the flex element 120 is moved, attached or detached, or flexed.

In one embodiment, the flex element 120 can include a second electrical element (not shown), coupled to the second coupling pad 121, and disposed to couple the second coupling pad 121 to a second relatively remote electrical or electronic node (not shown). In such cases, the second electrical element is substantially internal to the flex element 120, and is capable of maintaining an electrical or electronic connection when the flex element 120 is moved, attached or detached, or flexed.

In one embodiment, the flex element 120 can include a first multi-pin element 123 at a first end 124 disposed relatively near the device 110, capable of being coupled to a first multi-pin connector (not shown). In such cases, the multi-pin element 123 can be electrically or electronically coupled to a second multi-pin element (not shown) at a second end (not shown) disposed relatively far from the device 110, capable of being coupled to a second multi-pin connector (not shown). In the context of the invention, there is no particular requirement that the first multi-pin connector or the first multi-pin element 123 have the same number of pins as the second multi-pin connector or the second multi-pin element.

For example, in one embodiment, the flex element 120 can have a relatively flat and relatively elongated shape, and be relatively flexible and twistable along the relatively elongated direction of that shape, similar to a ribbon or a ribbon cable. In such cases, the flex element 120 can have the first multi-pin element 123 and the first end 124 disposed at a first end of the relatively elongated direction of that shape, and have the second multi-pin element and the second end disposed at a second end of the relatively elongated direction of that shape.

In one embodiment, the flex element 120 can have, coupled to it, one or more sets of assembly pieces (such as the first and second coupling pads, first and second electrical elements, and related elements) in addition to the assembly 100 described above. In such cases, the flex element 120 can include one additional set of assembly pieces disposed on a side of its relatively flat shape opposite the assembly 100 described above. For example, the flex element 120 could be disposed in a "T" shape, with the original set of assembly pieces disposed at one arm of the "T", the additional set of assembly pieces disposed at one arm of the "T", and the flex element 120 having its elongated direction at the base of the "T".

In one embodiment, the flex element 120 can have, coupled to it, one or more additional sets of assembly pieces, in addition to the assembly 100 described above, disposed laterally with respect to the side of the relatively elongated direction of its shape. For example, when the flex element 120 is disposed in a "T" shape, with at least one set of assembly pieces disposed at one arm of the "T" and the flex element 120 having its elongated direction at the base of the "T".

In such cases, the flex element 120 can include one or more first and second coupling pads, disposed for coupling to one or more corresponding assemblies, like or similar to the assembly 100. This can have the effect that the flex element 120 can be similarly coupled to one or more additional similar devices 110.

Device Improvements

In one embodiment, the device 110 can be disposed so that the first connector 111 and the second connector 112 are efficiently coupled to elements within the device 110. For example, if the device 110 is a speaker, the device 110 can be constructed so that the first connector 111 and the second connector 112 are coupled respectively to a first power supply node 113 and a second power supply node 114 within the device 110. In such cases, the device 110 can include the first power supply node 113, the second power supply node 114, a speaker diaphragm 115, and other speaker elements 116*a*, 116*b*, and 116*c*. This could have the effect that the device 110 can include a speaker with better performance within the same apparatus volume, or with better volume for the same device performance.

Method of Operation

Figure 4:
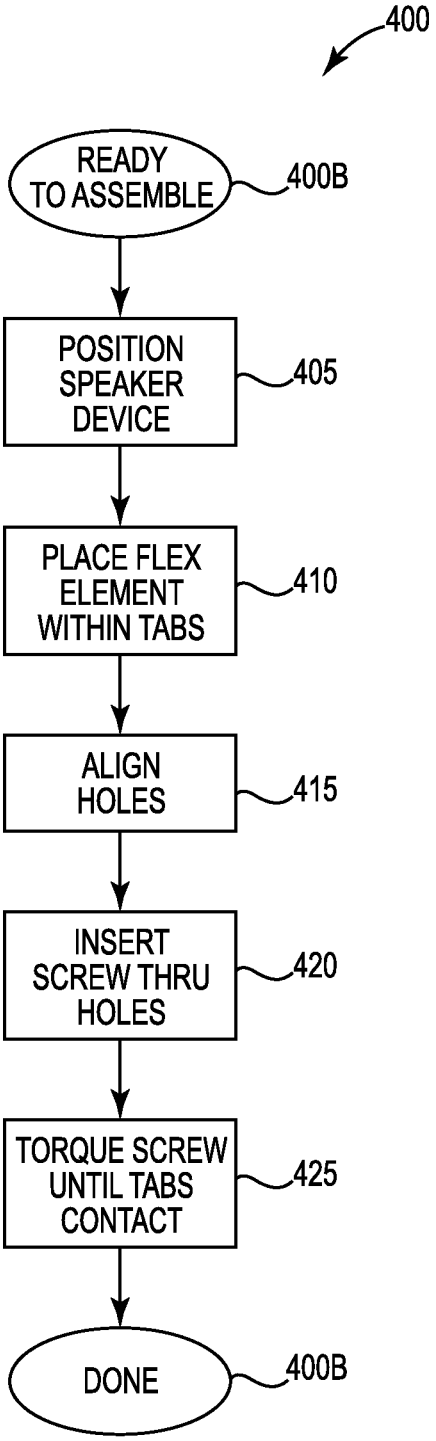
FIG. 4 shows a conceptual drawing of a method of constructing a device interconnect.

FIG. 4 shows a conceptual drawing of a method of constructing a device interconnect.

A method 400 includes a set of flow points and method steps. The method 400 can be performed by an operator, such as a person operating with physical elements, or such as a robotic device operating with physical elements, or otherwise.

A flow point 400A indicates that the assembly 100 is ready to be assembled. In one embodiment, the assembly 100 can be assembled from the device 110, the flex element 120, the screw 130, and associated coupling elements. In alternative embodiments, the assembly 100 can be assembled from more than one device 110 (whether similar devices or otherwise), or can be assembled from more than one flex element 120, or both.

At a step 405, the operator positions the device 110, such as a speaker element, with respect to a working location. For a first example, the working location can be a desired position that the device or subassembly can have within a finished mobile device or other portable or hand-held electronic device. For a second example, the working location can be a desired position that the device or subassembly can have with respect to a workbench, robotic tool, or otherwise.

At a step 410, the operator positions the flex element 120 within the space that is available between the first connector 111 and the second connector 112, before the first and second connector are clamped. In this step, the operator can position the first connector pad 121 and the second connector pad 122 in the space between the first connector 111 and the second connector 112.

At a step 415, the operator aligns the holes in the first connector 111 and the second connector 112 with the holes in the first connector pad 121 and the second connector pad 122. This can have the effect that when the holes in the first connector 111 and the second connector 112, and the holes in the first connector pad 121 and the second connector pad 122 are aligned, an aligned and unified hole (or other relatively aligned empty space) can be defined.

At a step 420, the operator inserts the screw 130 into the aligned and unified hole, through the aligned holes in the first connector 111 and the second connector 112, and the holes in the first connector pad 121 and the second connector pad 122. This can have the effect that the first connector 111 and the second connector 112 are physically relatively well coupled to the first connector pad 121 and the second connector pad 122.

At a step 425, the operator torques the screw 130, such as with a screwdriver, an electric screwdriver, or other torque tool, until the screw 130 is driven into the stop element 131. This can have the effect that the first connector 111 and the second connector 112 are compressed into contact with the first connector pad 121 and the second connector pad 122. This can also have the effect that the first connector 111 and the second connector 112 are electrically or electronically relatively well coupled to the first connector pad 121 and the second connector pad 122.

A flow point 400B indicates that the method 400 is complete.

Alternative Embodiments

After reading this application, those skilled in the art would recognize that the scope of spirit of the invention includes other and further techniques for providing an interconnect for an internal device, including other and further assemblies, circuits, and designs. After reading this application, those skilled in the art would recognize that the scope of spirit of the invention includes other and further techniques for providing both physical, and electrical or electronic, coupling between devices or subassemblies, including other and further assemblies, circuits, and designs.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular embodiments. Functionality may be separated or combined in procedures differently in various embodiments of the disclosure or described with different terminology. These and other variations, modifications, additions, and improvements may fall within the scope of the disclosure as defined in the claims.

The invention claimed is:

1. Apparatus including a device subassembly including a first connector and a second connector, said first connector and said second connector being coupleable to a first device, the first connector defining a first hole and the second connector defining a receiving aperture;

a contact subassembly including a first contact and a second contact formed on opposing sides of a contact subassembly structure, said first contact and said second contact being coupleable to a second device, and a second hole extending through the first contact, second contact and the contact subassembly structure;

said first connector and said second connector defining a space therebetween, said space allowing insertion of said first contact and said second contact and said contact subassembly structure, wherein insertion thereof aligns said first hole and said second hole; and a fastener extending through said first hole and said second hole, whereby said fastener affixes said first connector with respect to said first contact and affixes said second connector with respect to said second contact;

wherein said first connector and said first contact are electrically coupled, and said second connector and said second contact are electrically coupled.

2. Apparatus as in claim 1, including an electrical isolator disposed between said fastener and one or more of: said first contact pad, said second contact pad.

3. Apparatus as in claim 1, wherein said first device includes at least one of:

a speaker having a first electrical power connector coupleable to said first connector and having a second electrical power connector coupleable to said second connector;

a haptic feedback element.

4. Apparatus as in claim 1, wherein said fastener includes at least a portion thereof consisting of an electrically nonconductive material.

5. Apparatus as in claim 1, wherein said fastener includes at least a portion thereof electrically isolated from one or more of: said first contact pad, said second contact pad.

6. Apparatus as in claim 1, wherein said contact subassembly structure is formed from a flex element.

7. Apparatus as in claim 1, wherein said contact subassembly structure includes a physically flexible member.

8. Apparatus as in claim 6, wherein said flex element includes a T-shape having a first contact subassembly at a first arm of said T-shape and a second contact subassembly at a second arm of said T-shape.

9. Apparatus as in claim 1, wherein an end of said fastener is received in said receiving aperture.

10. Apparatus as in claim 9, wherein contact between said fastener affixes said position of said first connector with respect to said second connector in combination with said stop element.

11. Apparatus as in claim 9, wherein said receiving aperture is coupled to one or more of: said first connector, said second connector.

12. A method, including steps of disposing a first connector at an angle with respect to a second connector, said first connector and said second connector being coupleable to a first device, said first connector defining a first hole and, disposed with respect to said second connector to define a space therebetween;

inserting a contact subassembly, including a first contact and a second contact formed on opposing sides of the contact subassembly, into said space, said first contact and said second contact being coupleable to a second device, said contact subassembly defining a second hole;

aligning said first hole and said second hole; and inserting a fastener through said first and second holes to affix a position of said first connector with respect to a position of said first contact and affix a position of said second connector with respect to a position of said second contact;

tightening said fastener, thereby electrically coupling said first connector and said first contact, and whereby said steps of tightening electrically coupling said second connector and said second contact.

13. A method as in claim 12, including steps of disposing an electrical isolator between said fastener and one or more of: said first contact pad, said second contact pad.

14. A method as in claim 12, including steps of electrically coupling said first contact pad to a remote location.

15. The apparatus of claim 1, wherein the fastener comprises:

a body; and al electrical insulator on less than all of the body.

16. An interconnection mechanism, comprising:

a tab;

a base receptacle physically connected to the tab;

a flex element having a first side opposing a second side;

a first coupling pad formed on the first side of the flex element;

a second coupling pad formed on the second side of the flex element;

a connector extending through the base receptacle, the first coupling pad, and the second coupling pad and received in the base receptacle; wherein the connector is electrically isolated at least from the tab by an isolator.

17. The interconnection mechanism of claim 16, wherein the isolator forms a collar about a segment of the connector.

18. The interconnection mechanism of claim 16, wherein the connector electrically contacts the base receptacle.

19. The interconnection mechanism of claim 18, wherein the connector is electrically isolated from each of the tab, base receptacle, first coupling pad and second coupling pad.

20. The interconnection mechanism of claim 16, wherein the isolator is a coating on the connector.

* * * * *